United States Patent [19]

Green

[11] 4,014,287

[45] Mar. 29, 1977

[54] HIGH SPEED FLUID APPLICATOR

[75] Inventor: Harold W. Green, Framingham, Mass.

[73] Assignee: Comstock & Wescott, Inc., Cambridge, Mass.

[22] Filed: Aug. 4, 1975

[21] Appl. No.: 601,649

[52] U.S. Cl. ..... 118/7; 118/223; 118/261

[51] Int. Cl.[2] ..... B05C 1/02

[58] Field of Search ..... 118/7, 223, 8, 258, 118/261, 224, 259; 11/1 AD; 101/365, 350; 156/578, 477 B

[56] References Cited

UNITED STATES PATENTS

| | | | |
|---|---|---|---|
| 2,360,044 | 10/1944 | Dermody | 118/223 |
| 2,605,739 | 8/1952 | DeFlorez | 11/1 AD |
| 3,338,211 | 8/1967 | Nugarus | 118/261 |
| 3,410,713 | 11/1968 | Schneidereit | 118/7 X |
| 3,520,276 | 7/1970 | Martin | 118/8 |
| 3,866,568 | 2/1975 | Minami | 118/238 |

*Primary Examiner*—John P. McIntosh
*Attorney, Agent, or Firm*—James H. Grover

[57] ABSTRACT

Bookbinding apparatus for applying glue to the backbone edge of collated book sheets conveyed through a gluing station comprises counter rotating applicator rolls for transporting glue from a rectangular glue pot to the backbone the rolls substantially completely spanning the parallel sidewalls of the glue pot so that glue can not flow between the ends of the rolls and the side walls. Doctor blades extend from the ends of the glue pot to respective rolls so as to confine the adhesive below the rolls. One of the doctor blades is linearly retractable from its roll to an extent limited by a linearly adjustable stop which meters a volume of glue carried to the book in direct linear relation to the adjustment of the doctor blade stop.

6 Claims, 3 Drawing Figures

HIGH SPEED FLUID APPLICATOR

BACKGROUND

In the bookbinding art collated pages of a book are clamped in a conveyor and passed over an adhesive applicator, known in the art as a glue pot, holding a supply of adhesive. The adhesive is carried from the pot by one or more rolls partially immersed in the glue pot up to a gluing plane through which the backbone of the book is conveyed. In older gluers doctor blades control the amount of glue carried by the rolls to the gluing plane, but there is a need in modern high speed equipment not only to control the glue applied but to confine it against overflowing the glue pot as a result pf pumping of the glue by the rolls to the ends of the pot.

Accordingly one object of the present invention is to prevent overflow in high speed applicator. A related object is to provide a way of metering application of glue in linear relation to a metering adjustment.

STATEMENT OF INVENTION

According to the invention apparatus for applying adhesive to the parallel edges of sheets fed by a conveyor through a gluing station plane comprises an adhesive container with parallel sidewalls extending from an endwall, an applicator roll for transporting adhesive from the container to the gluing plane, the roll substantially completely spanning the sidewalls to bar adhesive flow between the ends of the roll and the sidewalls, and a doctor blade retractably spanning the adhesive surface bounded by the sidewalls, endwall and roll so as substantially completely to confine the adhesive below the bounded surface.

Further according to the invention the apparatus includes timing means linked to the conveyor for retracting the doctor blade as the sheets reach the gluing station, means guiding the doctor blade on a substantially linear path from the roll, and linearly adjustable stop means selectively limiting retraction of the blade to a position spaced from the roll, the stop means carrying calibrations indicating the selected limit, such that the indication is a linear measure of the volume of adhesive transported to the gluing plane through the space between the retracted blade and the roll.

DRAWINGS

DESCRIPTION

Figure 1:
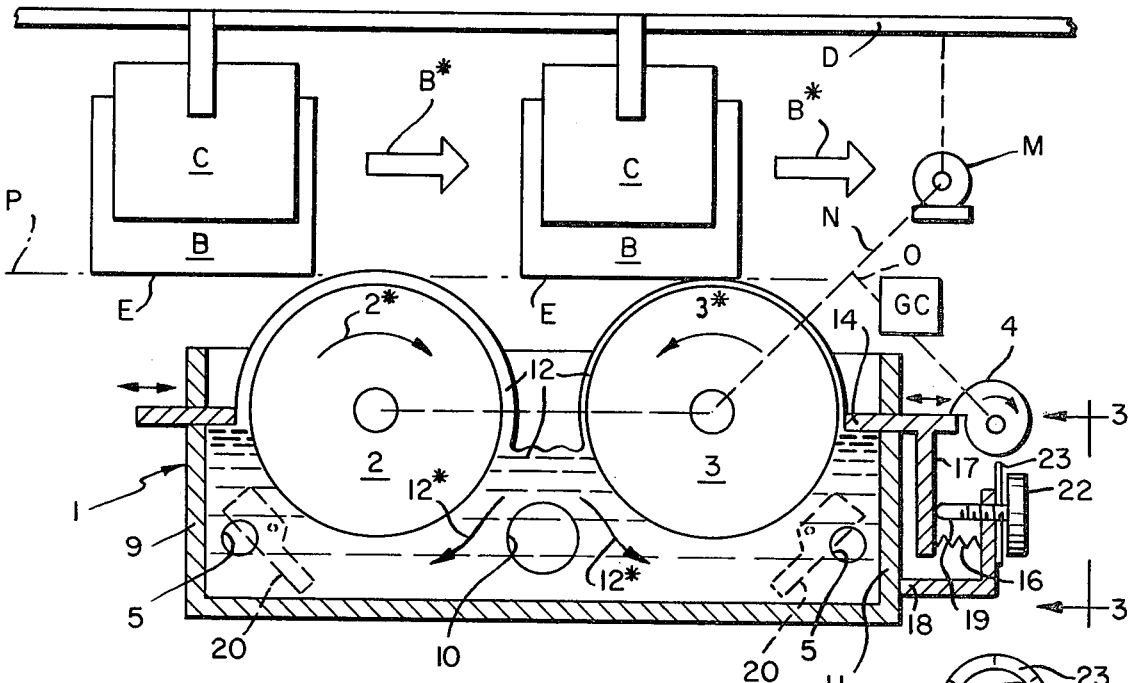
FIG. 1 is a side elevation showing partly in section a high speed adhesive applicator according to the invention.
Figure 3:
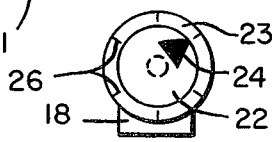
FIG. 3 is a section on lines 3—3 of FIG. 1.
Figure 2:
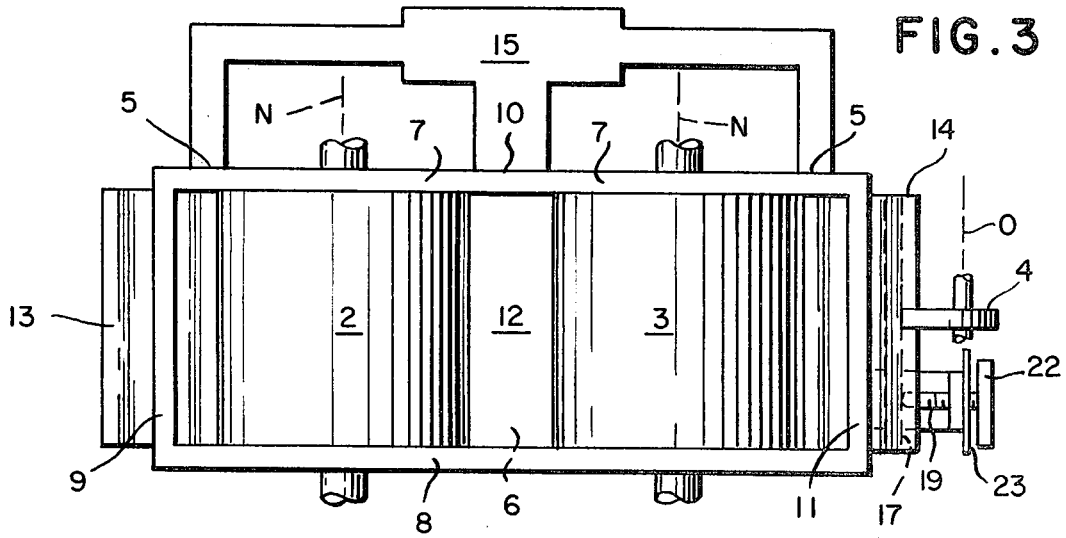
FIG. 2 is a plan view of the applicator.

The figures show a high speed applicator of adhesive to unbound edges E of the backbone of books B held by clamps C on a conveyor D which carries the books in the direction of the arrows B* at speeds as high as about 6000 inches per minute over a glue pot 1. The conveyor D is driven by a motor M also connected by a linkage N to applicator rolls 2 and 3, and by a linkage O through a gear change box GC to an adhesive control cam 4. The applicator rolls carry adhesive 12 from the glue pot to a gluing plane P through which the backbone edges E of the book are conveyed. The left roll 2 prewets the backbone with adhesive and the right roll 3 applies the full adhesive coating.

The glue pot 1 has a bottom 6, parallel sidewalls 7 and 8 and end walls 9 and 11 and holds a heated adhesive 12 such as animal glue which is of substantial viscosity as is well known in the adhesive art. Axles 13 and 14 for the applicator rolls are journalled through the sidewalls 7 and 8. According to one aspect of the invention the rolls substantially completely span the space between the sidewalls so that flow of the adhesive between the ends of the rolls and the sidewalls is effectively barred. Considering the viscosity of bookbinding adhesive a clearance between the roll ends and sidewalls of about 0.002 inch is effective to bar appreciable adhesive flow, and yet allow a lubricating film of adhesive between the rolls and sidewalls.

The reason that adhesive will tend to flow past the ends of the rolls is that in high speed applicators the rotation of the rolls pumps the glue. As shown in FIG. 1, the rolls 2 and 3 rotate in opposite directions 2* and 3*, such that the immersed portions of the rolls pump glue in both directions 12* toward the end walls 9 and 11 of the glue pot 1. The pumping tends to depress a meniscus between the rolls and raise a liquid head between each roll and the end wall. At the roll speeds necessary for high speed application (e.g. over 300 feet per minute linear, peripheral velocity) the adhesive head would be pumped upwardly out of the ends of the glue pot.

According to a further aspect of the invention outpumping of the adhesive is prevented by substantially completely spanning the surface of the adhesive head between each roll and end wall and the adjacent sidewalls with doctor blades 13 and 14. As is known in the art the spacing of the doctor blades from the rolls controls the amount of adhesive applied. Additionally the doctor blades and rolls of the present high speed applicator confine the adhesive below them, which confinement in cooperation with the barring of adhesive flow around the ends of the applicator rolls affords positive control of adhesive. As is more fully explained, the spacing of the right doctor blade 14 from the right roll 3 is adjusted during each pass of a book B thereover, such that the doctor blade is substantially in contact with the full length of the roll 3 and the adhesive is completely doctored dry from the roll until the book backbone reaches and just passes over the roll. Then the doctor blade space is opened to release pumped adhesive on to the emerging portion of the roll. By confining the adhesive head positively, as described above, the doctor blade 14 alone precisely controls the amount of adhesive picked up by the applicator roll 3, and changes in adhesive head pressure are not caused by variations in flow around the applicator roll, for example. Excess pressure of the adhesive head is prevented by controlled flow of adhesive out of relief ports 5 connected to a reservoir 15 which returns adhesive through a supply port 10. Flow of adhesive through the relief ports 5 is adjusted by pivotted barriers 20.

The controlling doctor blade 14 is slidingly supported in the end wall 11 for linear reciprocation to and from the periphery of the roll. A spring 16 connected between a flange 17 depending from the blade and a bracket 18 on the end wall 11 yieldingly urges the blade 14 away from the roll 3. Spring retraction of the blade is limited by the control cam 4 and by a manually adjustable stop 19. Until a book reaches and just passes over the right hand roll 3, the cam 4 holds the doctor blade against the roll preventing adhesive transfer. When the leading end of the book backbone B just passes the rop of the roll, the cam abruptly opens the doctor blade spacing allowing adhesive to be carried by the rolls to the backbone. As a result no adhesive will be applied to the vertical edges of the sheets where adhesive is highly undesirable. Instead there will be a short area on the leading end of the backbone E which is substantially dry of adhesive. Then a film of adhesive will extend from the dry area rearwardly of the backbone, and the film will have a clearly defined leading edge adjacent the dry area.

According to a still further aspect of the invention the amount of adhesive finally applied by the roll 3 is precisely controlled by the stop 19 which is linearly adjustable relatively to the linear sliding movement of the doctor blade 14. The stop 19 is threaded and held in threads in the bracket 18, and carries a manually adjustable knob 22 with an index mark 24 pointing at a scale of linear calibrations 26 on a bezel 23 mounted on the bracket 19. Although it may be generally old to calibrate positions of a doctor blade the present invention further makes possible an accurate setting of the knob index mark 24 at a calibration 26 which is in linear proportion to the spacing of the doctor blade 14 and hence the volume of adhesive carried by the roll 3. The reason for this linear relation is threefold. First, the doctor blade slides linearly relative to the applicator roll 3. Second, rotation of the knob 22 causes linear adjustment of the threaded stop 19. And third, the scale of calibrations 26 on the bezel 23 is linear. Thus an operator may select a precise setting of the knob at any part of the linear calibration scale with the assurance that a precisely corresponding volume of adhesive will be applied to the book backbone.

It should be understood that the present disclosure is for the purpose of illustration only and that this invention includes all modifications and equivalents which fall within the scope of the appended claims.

I claim:

1. Apparatus for applying adhesive to the parallel edges of sheets fed by a conveyor through a gluing station plane, comprising an adhesive container with parallel sidewalls extending from opposite endwalls, two applicator rolls for transporting adhesive from the container to the gluing plane, the rolls substantially completely spanning the sidewalls to bar adhesive flow between the ends of the rolls and the sidewalls, each roll rotating counter to the other and through the adhesive toward an end wall and being the sole means to pump a head of adhesive between the roll sidewalls and end wall, the second roll rotating counter to the feed of the sheets, a doctor blade extending from each end wall and spanning the sidewalls, the blade being movable between a position substantially in contact with the full length of the roll and a position spaced from the roll, the blade substantially doctoring the roll dry of adhesive in its roll contacting position and in its retracted position allowing transport of adhesive by the roll from the head directly to the gluing plane, and timing means linked to at least one of the doctor blades for retracting the one blade from contacting position to spaced position as the sheets are just past the gluing station, so that the leading end of the sheet edges is substantially dry of adhesive and a film of adhesive with a clearly defined leading edge is applied to the sheet edges rearwardly of the dry end.

2. Apparatus according to claim 1 wherein the timing means is linked to conveyor drive means.

3. Apparatus according to claim 1 including means guiding the doctor blade on a substantially linear path from the roll, and linearly adjustable stop means selectively limiting retraction of the blade to a position spaced from the roll, the stop means carrying calibrations indicating the selected limit, such that the indication is a linear measure of the volume of adhesive transported to the gluing plane through the space between the retracted blade and the roll.

4. Apparatus for applying adhesive to the parallel edges of sheets fed by a conveyor through a gluing station plane, comprising an adhesive container with parallel sidewalls extending from opposite endwalls, two applicator rolls for transporting adhesive from the container to the gluing plane, the rolls substantially completely spanning the sidewalls to bar adhesive flow between the ends of the rolls and the sidewalls, each roll rotating counter to the other through the adhesive toward an end wall to pump a head of adhesive between the roll sidewalls and end wall, a doctor blade extending from each end wall and spanning the sidewalls, the blade being movable between a position substantially in contact with the full length of the roll and a position spaced from the roll, the blade substantially doctoring the roll dry of adhesive in its roll contacting position and in its retracted position allowing transport of adhesive by the roll from the head directly to the gluing plane, timing means linked to at least one of the doctor blades for retracting the one blade from contacting position to spaced position as the sheets are just past the gluing station, so that the leading end of the sheet edges is substantially dry of adhesive and a film of adhesive with a clearly defined leading edge is applied to the sheet edges rearwardly of the dry end; and the container having a relief port in the pressure head and a supply port outside the head, the ports having a fluid interconnection and the rotation of the roll pumping adhesive out of the container through the relief port and back in through the supply port thereby to circulate adhesive continuously through the pressure head.

5. Apparatus for applying adhesive to material fed by a conveyor through a gluing station plane, comprising an adhesive container with parallel sidewalls extending from an endwall, an applicator roll for transporting adhesive from the container to the gluing plane, the roll substantially completely spanning the sidewalls to bar adhesive flow between the ends of the roll and the sidewalls, a doctor blade extending from the end wall substantially into contact with the full length of the roll, the roll rotating through the adhesive toward the end wall to pump a pressure head of adhesive between the roll sidewalls and end wall, and the container having a relief port in the pressure head and a supply port outside the head, the ports having a fluid interconnection and the rotation of the roll pumping adhesive out of the container through the relief port and back in through the supply port thereby to circulate adhesive continuously through the pressure head.

6. Apparatus according to claim 5 wherein the interconnection between the ports includes a reservoir.

* * * * *